US006615730B2

(12) United States Patent
Tokiwa

(10) Patent No.: US 6,615,730 B2
(45) Date of Patent: Sep. 9, 2003

(54) METHOD AND APPARATUS FOR CONTROLLING ROTARY PRESSES IN POWER FAILURE

(75) Inventor: Shizurou Tokiwa, Zushi (JP)

(73) Assignee: Tokyo Kikai Seisakusho, Ltd. (JP)

( * ) Notice: Subject to any disclaimer, the term of this patent is extended or adjusted under 35 U.S.C. 154(b) by 0 days.

(21) Appl. No.: 10/084,771

(22) Filed: Feb. 25, 2002

(65) Prior Publication Data

US 2002/0144609 A1 Oct. 10, 2002

(30) Foreign Application Priority Data

Apr. 9, 2001 (JP) ..... 2001-109471

(51) Int. Cl.[7] ..... B41F 13/24
(52) U.S. Cl. ..... 101/484; 101/171; 101/228
(58) Field of Search ..... 101/484, 228, 101/247, 177, 216, 171; 318/372, 280

(56) References Cited

U.S. PATENT DOCUMENTS 4,965,497 A * 10/1990 Rodi et al. ..... 318/372
5,365,844 A * 11/1994 Miyashige ..... 101/228
5,588,364 A * 12/1996 Bolza-Schunemann ..... 101/247
6,109,176 A * 8/2000 Fujio et al. ..... 101/216
2002/0174785 A1 * 11/2002 Sasaki ..... 101/229

FOREIGN PATENT DOCUMENTS

| | | |
|---|---|---|
| JP | 60-36946 B2 | 8/1985 |
| JP | 3037650 | 2/2000 |
| JP | 3059081 | 4/2000 |

* cited by examiner

*Primary Examiner*—Charles H. Nolan, Jr.
(74) *Attorney, Agent, or Firm*—McGlew and Tuttle, P.C.

(57) ABSTRACT

The apparatus for controlling, in a power failure, a rotary press that separately drives a printing section and a folding section with independent drive sources, pulls a printing material that is being braked in a paper feeding section at least by the folding section, brings a blanket cylinder of the printing section into contact with the printing material to produce printing impressions by changing over the braking of the printing material to a braking mode with a constant braking force upon interruption of power feeding due to a main power failure, detecting a voltage drop caused by the power failure to output a power failure signal, changing over to a battery power supply, separating a blanket cylinder that is at press from the printing material, and decelerating and bringing to a halt a printing material pulling mechanism at the folding section within a predetermined time.

8 Claims, 5 Drawing Sheets

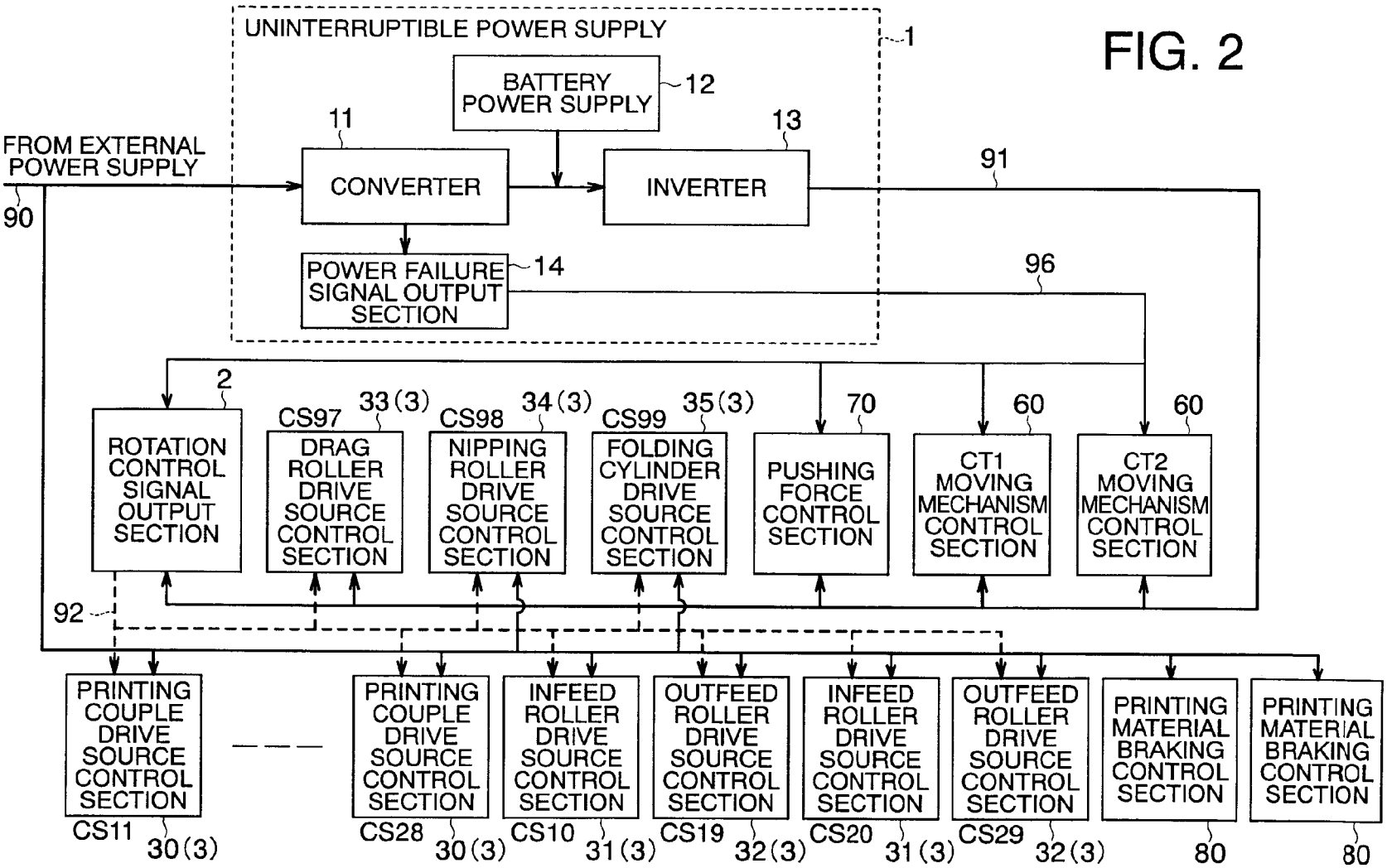
FIG. 2
UNINTERRUPTIBLE POWER SUPPLY
1
BATTERY POWER SUPPLY
12
INVERTER
13
CONVERTER
11
POWER FAILURE SIGNAL OUTPUT SECTION
14
FROM EXTERNAL POWER SUPPLY
90
91
96
ROTATION CONTROL SIGNAL OUTPUT SECTION
2
DRAG ROLLER DRIVE SOURCE CONTROL SECTION
CS97
33 (3)
NIPPING ROLLER DRIVE SOURCE CONTROL SECTION
CS98
34 (3)
FOLDING CYLINDER DRIVE SOURCE CONTROL SECTION
CS99
35 (3)
PUSHING FORCE CONTROL SECTION
70
CT1 MOVING MECHANISM CONTROL SECTION
60
CT2 MOVING MECHANISM CONTROL SECTION
60
92
PRINTING COUPLE DRIVE SOURCE CONTROL SECTION
CS11
30 (3)
PRINTING COUPLE DRIVE SOURCE CONTROL SECTION
CS28
30 (3)
INFEED ROLLER DRIVE SOURCE CONTROL SECTION
CS10
31 (3)
OUTFEED ROLLER DRIVE SOURCE CONTROL SECTION
CS19
32 (3)
INFEED ROLLER DRIVE SOURCE CONTROL SECTION
CS20
31 (3)
OUTFEED ROLLER DRIVE SOURCE CONTROL SECTION
CS29
32 (3)
PRINTING MATERIAL BRAKING CONTROL SECTION
80
PRINTING MATERIAL BRAKING CONTROL SECTION
80

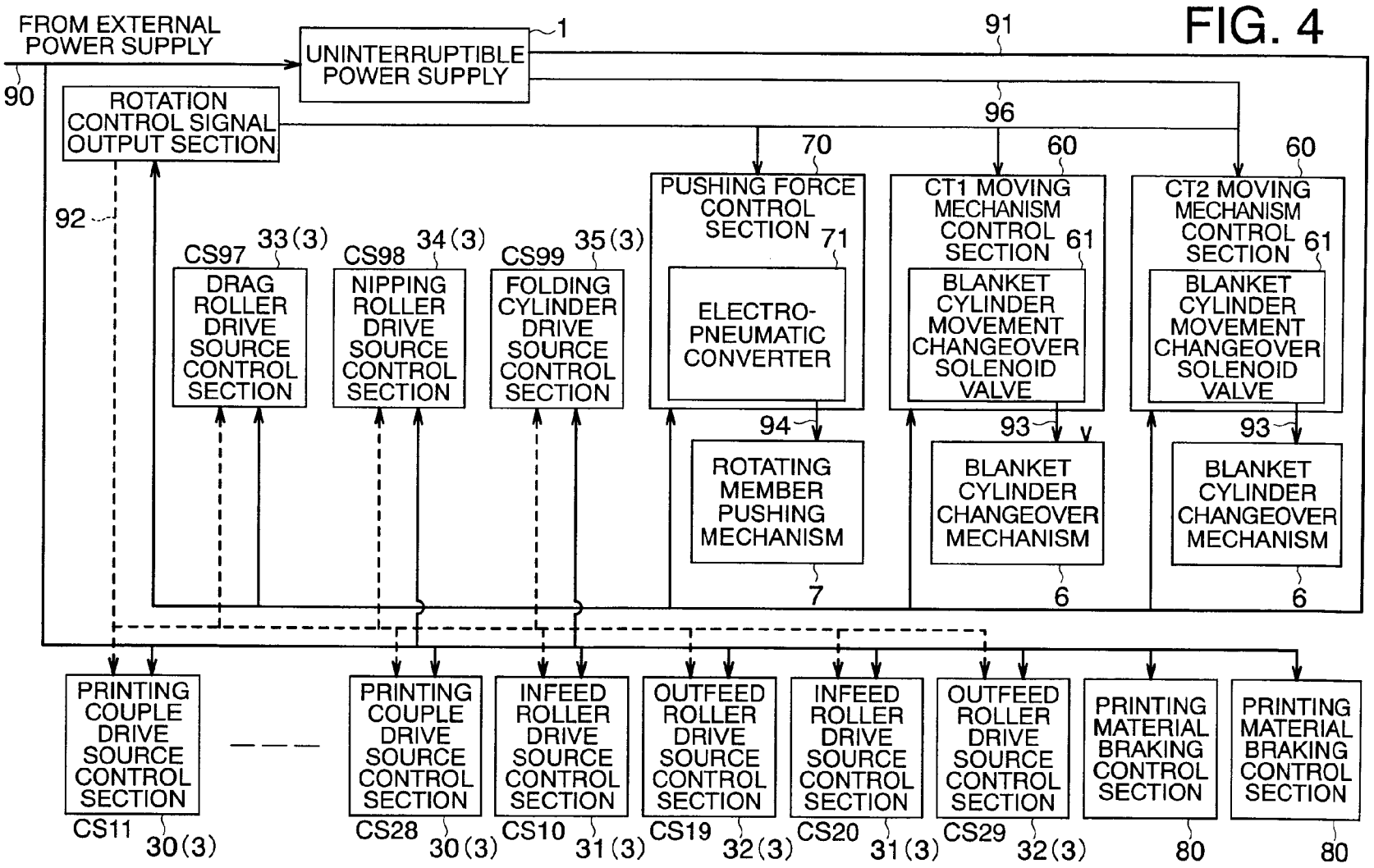
FIG. 4
FROM EXTERNAL POWER SUPPLY
90
ROTATION CONTROL SIGNAL OUTPUT SECTION
92
UNINTERRUPTIBLE POWER SUPPLY
1
91
96
DRAG ROLLER DRIVE SOURCE CONTROL SECTION
CS97
33 (3)
NIPPING ROLLER DRIVE SOURCE CONTROL SECTION
CS98
34 (3)
FOLDING CYLINDER DRIVE SOURCE CONTROL SECTION
CS99
35 (3)
PUSHING FORCE CONTROL SECTION
70
ELECTRO-PNEUMATIC CONVERTER
71
ROTATING MEMBER PUSHING MECHANISM
94
7
CT1 MOVING MECHANISM CONTROL SECTION
60
BLANKET CYLINDER MOVEMENT CHANGEOVER SOLENOID VALVE
61
93
BLANKET CYLINDER CHANGEOVER MECHANISM
6
CT2 MOVING MECHANISM CONTROL SECTION
60
BLANKET CYLINDER MOVEMENT CHANGEOVER SOLENOID VALVE
61
93
BLANKET CYLINDER CHANGEOVER MECHANISM
6
PRINTING COUPLE DRIVE SOURCE CONTROL SECTION
CS11
30 (3)
PRINTING COUPLE DRIVE SOURCE CONTROL SECTION
CS28
30 (3)
INFEED ROLLER DRIVE SOURCE CONTROL SECTION
CS10
31 (3)
OUTFEED ROLLER DRIVE SOURCE CONTROL SECTION
CS19
32 (3)
INFEED ROLLER DRIVE SOURCE CONTROL SECTION
CS20
31 (3)
OUTFEED ROLLER DRIVE SOURCE CONTROL SECTION
CS29
32 (3)
PRINTING MATERIAL BRAKING CONTROL SECTION
80
PRINTING MATERIAL BRAKING CONTROL SECTION
80

METHOD AND APPARATUS FOR CONTROLLING ROTARY PRESSES IN POWER FAILURE

CROSS REFERENCE TO RELATED APPLICATIONS

This application claims priority from Japanese patent application Serial no. 2001-109471 filed Apr. 9, 2001, the contents of which are incorporated by reference herein.

BACKGROUND OF THE INVENTION

1. Field of the Invention

The present invention relates generally to a method and apparatus for controlling a rotary press in a power failure, and more specifically to a method and apparatus for controlling, in a power failure, a so-called shaftless rotary press that produces printing impressions on paper by separately driving printing sections and folding sections with independent drive units.

2. Description of the Related Art

Conventional types of rotary presses accomplish printing operation by driving the entire rotary press with an integrated drive-source assembly that connects a plurality of drive units (main motors) provided on printing sections, folding sections and other components comprising the rotary press via a drive transmission shaft (main shaft) and a clutch, as disclosed in Japanese Published Unexamined Patent Application No. 60/36946.

In recent years, on the other hand, so-called shaftless rotary presses in which different driven components are driven independently by separate drive sources so that synchronous control can be achieved electrically so as to adequately match the rotating speeds and phases of the drive sources and the driven components, as disclosed in Japanese Patent Nos. 3037650 and 3059081, for example, have been widely used because they have various advantages in printing operation.

However, when electrical synchronous control becomes inoperative in the shaftless rotary press during printing operation due to a power failure, for example, drive sources and driven components tend to continue rotation owing to the inertial forces thereof, leading not only to deteriorated printing performance but also to various troubles, such as the breakage of the web due to uneven tension on the web and the resulting unwanted clinging of the broken web around the rotary parts. It takes much time to restore the normal printing operation by removing the clung web and re-threading the web into the traveling path. These time-consuming restoring operations has made it difficult to quickly resume printing even after the restoration of main power supply. As a result, these operational troubles have posed a big problem difficult to solve especially in newspaper printing and other printing jobs requiring speed and timeliness.

As a solution for this problem, on the other hand, means for stopping the rotary press by individually braking driven components of a shaftless rotary press system, as disclosed in Japanese Patent No. 3037650, when power feeding is interrupted due to a main power failure. In this type of rotary-press control, however, there is a difference in the inertial forces of the driven components that keep rotating after power feeding has been interrupted, and accordingly there is no small difference in braking forces to put brake on the rotation caused by the inertial forces. In addition, there is some time lag in the start of braking in each braking section. All these factors have caused variability in the time required for the rotating speed of each driven component begins to decrease due to braking as well as the time required for each driven component comes to a halt. This results in uneven tensions on the traveling paper web in the rotary press, leading to the breakage of the web or the clinging of the web around the rotary parts.

SUMMARY OF THE INVENTION

It is an object of the present invention to switch over the operation of a shaftless rotary press in which the components thereof are subjected to electrical synchronous control when power feeding is interrupted due to a failure of main power supply so that a traveling paper web can be braked with a constant braking force to prevent uneven tensions from being exerted on the paper web even when power feeding is discontinued due to a main power failure, thereby, in a breakage of the paper web, preventing the broken web from clinging around the rotary components.

It is another object of the present invention to switch over the operation of a shaftless rotary press in which the components thereof are subjected to electrical synchronous control when power feeding is interrupted due to a failure of main power supply so that a traveling paper web can be braked with a constant braking force that is larger than the braking force before the interruption of power feeding to prevent uneven tensions from being exerted on the paper web even when power feeding is discontinued due to a power failure, thereby, in a breakage of the paper web, preventing the broken web from clinging around the rotary components.

The present invention that can accomplish these objectives makes it possible to resume the printing operation of the shaftless rotary press immediately after the power is restored.

The present invention also accomplishes the control, in a main power failure, of a rotary press that carries out printing operation by driving the printing section and the folding section with separate drive sources, pulling the printing material that is currently being braked in the paper feeding section, and bringing the blanket cylinder of the printing section into contact with the printing material; the control to cope with the power failure being accomplished in such a manner that the braking of the printing material in the paper feeding section is changed over to a braking mode with a constant braking force as soon as power feeding to the rotary press is interrupted in the main power failure, a power failure signal is output by detecting a voltage drop due to the power failure, the power supply is changed over to a battery power supply, the blanket cylinder is detached from the printing material with the battery power upon receipt of the power failure signal, and the printing material pulling mechanism in the folding section is decelerated and brought to an emergency halt within a given length of time also with the battery power upon receipt of the power failure signal.

The present invention accomplishes the control, in a power failure, of a rotary press that carries out printing operation by driving the printing section and the folding section with separate drive sources, pulling the printing material that is currently being braked in the paper feeding section, and bringing the blanket cylinder of the printing section into contact with the printing material; the control to cope with the power failure being accomplished in such a manner that the braking of the printing material in the paper feeding section is changed over to a braking mode with a constant braking force that is greater than the braking force before the power failure as soon as power feeding to the rotary press is interrupted in the power failure, a power failure signal is output by detecting a voltage drop due to the power failure, the power supply is changed over to a battery power supply, the blanket cylinder is detached from the printing material with the battery power upon receipt of the power failure signal, and the printing material pulling mechanism in the folding section is decelerated and brought to an emergency halt within a given length of time interval also with the battery power upon receipt of the power failure signal.

The present invention accomplishes the control, in a power failure, of a rotary press comprising separate drive sources in the printing section and the folding section thereof, a printing material braking mechanism for countering the pulling of the printing material in the paper feeding section thereof, a blanket cylinder moving mechanism for selectively moving the blanket cylinder in a direction away from the direction in which the blanket cylinder comes in contact with the printing material in the printing section thereof, and a printing material pulling mechanism for pulling the printing material by the rotation of a drag roller at least in the most upstream part of the folding section; the improvement comprising a printing material braking mechanism adapted to be changeable to a braking mode with a constant braking force as soon as power feeding to the rotary press is interrupted due to a main power failure, an uninterruptible power supply having a power failure signal output section with the power input side thereof connected to an external power supply for outputting a power failure signal by detecting a voltage drop on the power input side at the power failure and a battery power supply for outputting power to the power output side thereof upon detection of the voltage drop on the power input side at the power failure, a drive source control section provided for each drive source for controlling the rotation of the drive sources in the printing section and the folding section, a rotation control signal output section for outputting a signal for the synchronous control of the rotation of each drive source, and a moving mechanism control section for operating the blanket cylinder moving mechanism to selectively bringing the blanket cylinder into contact with or away from the printing material; at least the drag roller drive source control section, the rotation control signal output section and the moving mechanism control section of the printing material pulling mechanism at least on the most upstream side of the folding section being connected to the power output side of the uninterruptible power supply, and at least the rotation control signal output section and the moving mechanism control section being connected to the power failure signal output section of the uninterruptible power supply, so that the blanket cylinder is detached from the printing material based on the signal from the power failure signal output section, and the printing material pulling mechanism on the most upstream side of the folding section is controlled for deceleration and stop based on the output signal of the rotation control signal output section.

With this construction of the present invention, the following operation is carried out when a power supply failure, such as the interruption of an external power supply, occurs.

First, when the voltage on the power input side of the uninterruptible power supply drops, the power failure signal output section of the uninterruptible power supply outputs a power failure signal, and feeds power to the power output side from the battery power supply. As power feeding is interrupted due to a power failure, such as a failure of an external power supply, the printing material braking mechanism in the paper feeding section is changed over to a state where the braking force is kept constant.

The power failure signal output by the power failure signal output section is input into the rotation control signal output section and the moving mechanism control section. The power output by the battery power supply to the power output side is input into the drag roller drive source control section, the rotation control signal output section and the moving mechanism control section of the printing material pulling mechanism at least on the most upstream side of the folding section.

The rotation control signal output section and the moving mechanism control section are changed over to a rotary press stop mode upon receipt of a power failure signal, and start operation in the rotary press stop mode based on the power fed by the battery power supply. The drag roller drive source control section continues drive source control operation based on the rotary press stop mode signal output by the rotation control signal output section in accordance with the power fed by the battery power supply. That is, the rotation control signal output section outputs a control signal that gradually decelerate and bring to a halt the drag roller of the printing material pulling mechanism on the most upstream side of the folding section, so that the printing material that is traveling in the rotary press is stopped after deceleration with a given length of time.

Upon receipt of this control signal, the drag roller drive source control section decelerates the rotation of the drag roller of the printing material pulling mechanism on the most upstream side of the folder and finally brings it to a halt. The time from deceleration to stop is determined within a time interval in which power can be fed from the battery power supply.

Upon receipt of the power failure signal, the moving mechanism control section immediately actuates the blanket cylinder moving mechanism to move the blanket cylinder from the printing position at which the blanket cylinder comes in contact with the printing material to a non-printing position at which the blanket cylinder is detached from the printing material.

The printing material braking mechanism in the paper feeding section that has been changed over to a constant braking force mode continues braking with a constant braking force the printing material that is being pulled by the drag roller of the printing material pulling mechanism on the most upstream side of the folding section.

As described above, the rotation control signal output section, the drag roller drive source control section, the moving mechanism control section and the printing material braking mechanism are operated so that the printing material traveling in the rotary press is decelerated and brought to a halt by electrical control under the influence of the constant braking force.

BRIEF DESCRIPTION OF THE DRAWINGS

FIG. 2 is a block diagram showing the construction of the control apparatus in the event of a power failure and showing in more detail the construction of the uninterruptible power supply.

FIG. 4 is a block diagram showing the construction of the control apparatus in the event of a power failure and showing in more detail the construction of the moving mechanism control section.

DETAILED DESCRIPTION OF THE PREFERRED EMBODIMENTS

Figure 1:
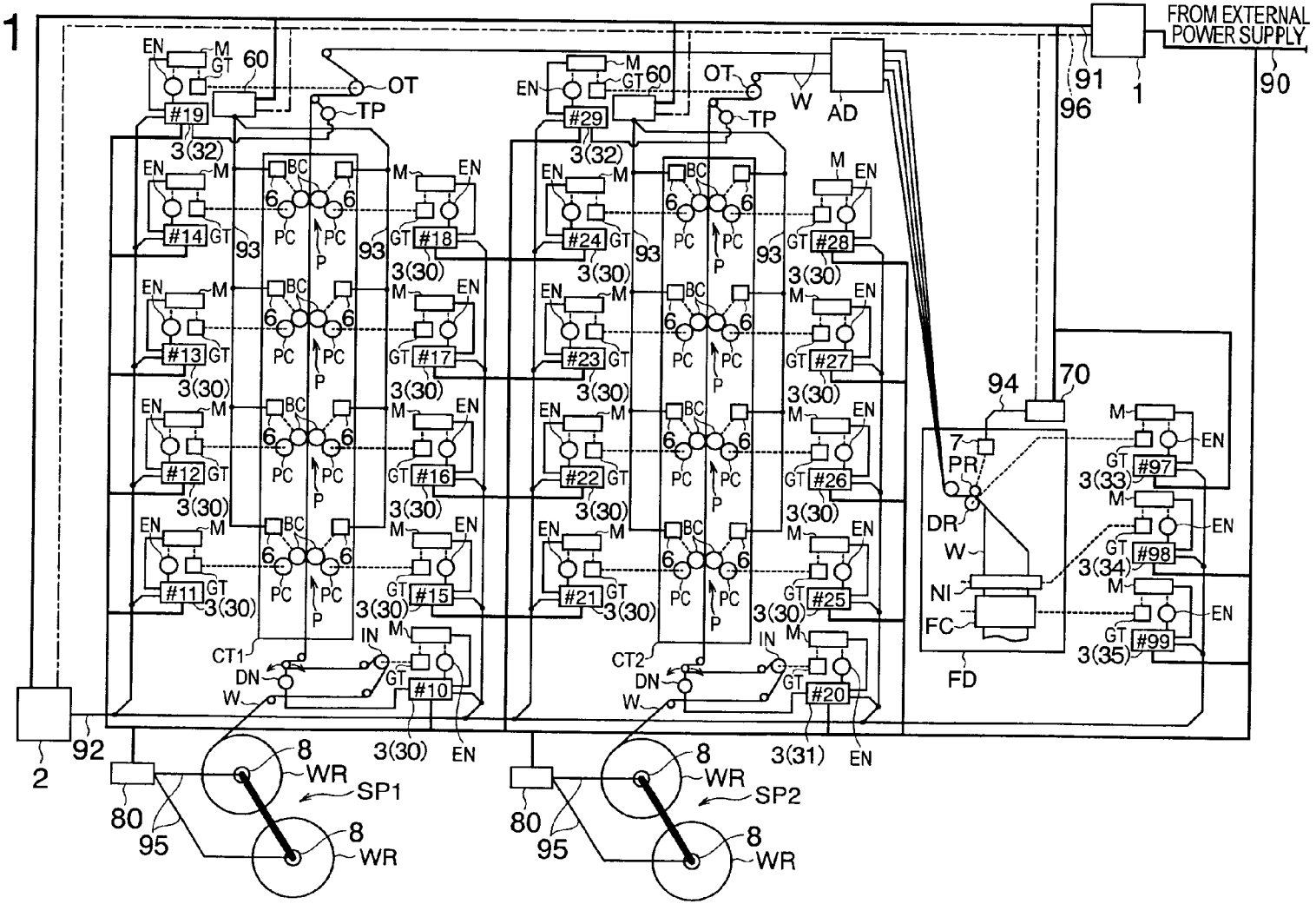
FIG. 1 is a diagram of assistance in explaining an example in which an embodiment of the control apparatus in the event of a power failure according to the present invention is applied to an offset rotary press.
Figure 3:
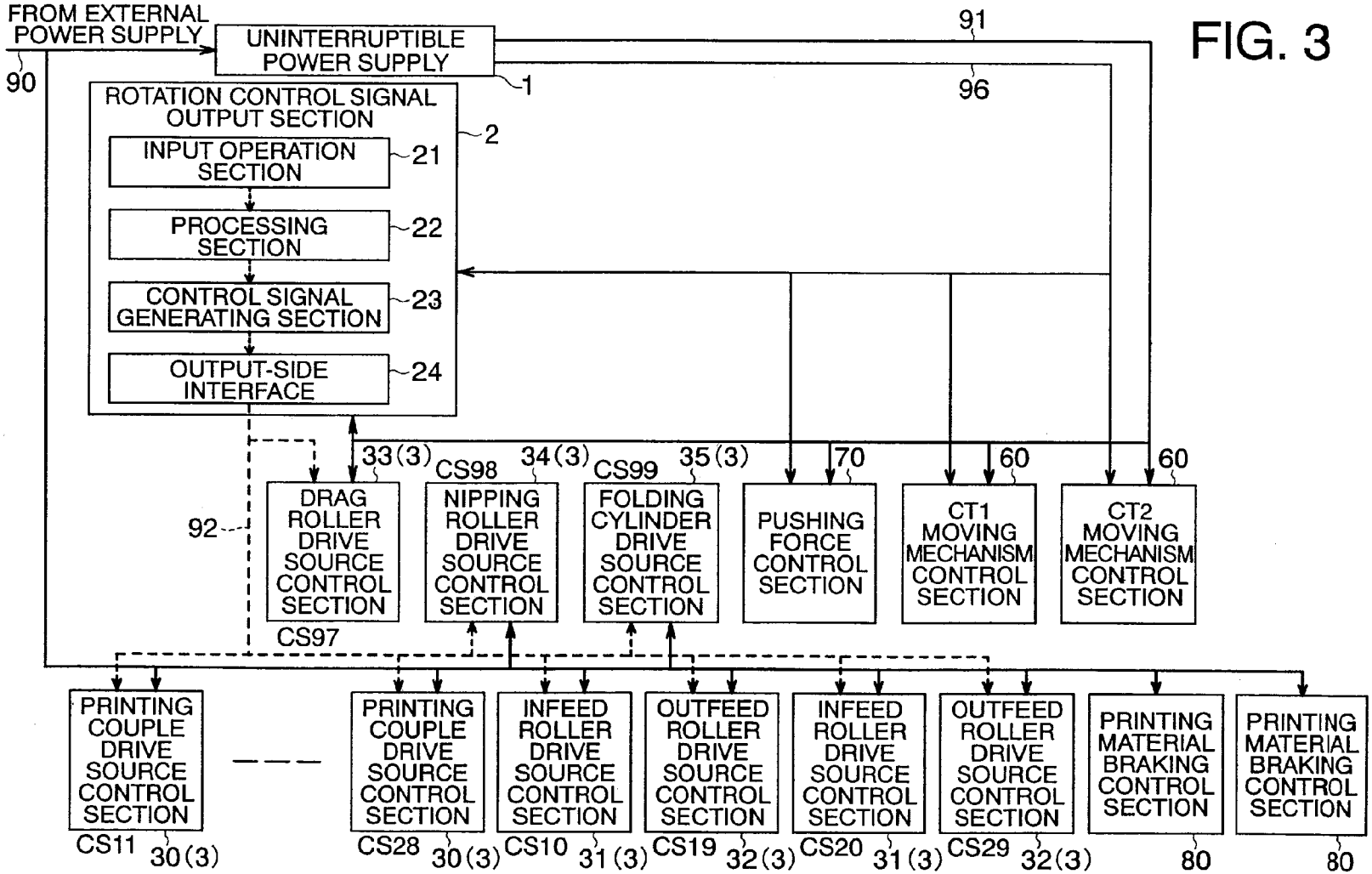
FIG. 3 is a block diagram showing the construction of the control apparatus in the event of a power failure and showing in more detail the construction of the rotation control signal output section.

FIG. 1 is a diagram of assistance in explaining an example in which an embodiment of the control apparatus in the event of a power failure according to the present invention is applied to an offset rotary press. FIG. 1 shows an offset rotary press comprising printing sections CT1 and CT2 each having four printing mechanisms P, a folding section FD for cutting and folding a printed continuous paper web W into predetermined printing images, and paper feeding sections SP1 and SP2 provided for each of the printing section CT1 and CT2 for feeding the paper web W as a printing material to the corresponding printing sections CT1 and CT2.

Each of the printing mechanisms P in the printing sections CT1 and CT2 has two sets of printing couples of blanket cylinders BC and plate cylinders PC.

The plate cylinder PC of each printing couple is driven by a drive means M via a transmission means GT. The blanket cylinder BC is driven by the drive means M via the plate cylinder PC and a transmission means (not shown) provided between both the plate cylinder PC and the blanket cylinder BC. That is, the printing mechanisms P in each of the printing sections CT1 and CT2 are driven separately by independent drive means M. In the vicinity of the upstream of each of the printing sections CT1 and CT2 provided is an infeed roller IN for feeding the paper web W to the corresponding printing section CT1 or CT2. In the vicinity of the downstream of each of the printing sections CT1 and CT2 provided is an outfeed roller OT for pulling out the paper web W from the corresponding printing section CT1 or CT2; these rollers being driven by the drive means M via the transmission means GT. On the upstream side of the infeed roller IN provided is a first tension detecting means DN that is a tension detecting mechanism using a dancer roller, for example, whereas on the upstream side of the outfeed roller OT provided is a second tension detecting means TP that is a tension detecting mechanism using a strain gauge, for example.

A folding cylinder FC of the folding section FD is driven by the drive means M via the transmission means GT, and the other cylinders thereof by the drive means M via transmission means (not shown) provided between the folding cylinder FD and the other cylinders. In the vicinity of the upstream of the folding cylinder FC provided is a nipping roller NI for feeding the paper web W into a gap between the folding cylinder FD and the other cylinders that are in close contact with each other. On the most upstream side of the folding section FD provided is a drag roller DR for feeding the paper web W to the folding section FD; all these rollers being driven by the drive means M via the transmission means GT.

Note that all the aforementioned cylinders and rollers may be driven directly by the drive means M eliminating the transmission means GT.

Each of the drive means M has (i) a printing couple drive source control section 30 for #11~#18 and #21~#28, (ii) an infeed roller drive source control section 31 for #10 and #20, (iii) an outfeed roller drive source control section 32 for #19 and #29, (iv) a drag roller drive source control section 33 for #97, (v) a nipping roller drive source control section 34 for #97, and (vi) a folding cylinder drive source control section 35 for #99. In addition, a rotary encoder with Z phase (an incremental encoder; hereinafter referred to as an encoder) EN that is a feedback signal output section for outputting a first pulse signal as many as the number proportional to the rotational angular displacement of the drive means M and outputting a second pulse signal (Z-phase pulse signal) per rotation is also provided. The drive source control section 3 is connected to the rotation control signal output section 2 via an input-side interface 36 which will be described with reference to FIG. 5 and a connecting cable 92.

Furthermore, a blanket cylinder changeover mechanism 6 that is a blanket cylinder moving mechanism using an air cylinder for selectively moving the blanket cylinder BC so as to cause the blanket surface of the blanket cylinder BC to make contact with, or detach from the paper web W is provided on each printing couple of the printing sections CT1 and CT2. Each of the blanket cylinder changeover mechanism 6 is connected to a moving mechanism control section 60 for controlling the operation of the blanket cylinder changeover mechanism 6 on the printing section CT1 or CT2. On the drag roller DR provided on the most upstream side of the folding section FD provided are rotating members PR that are rotatable while forcing the paper web W onto the drag roller DR at a plurality of locations apart from each other in the axial direction of the drag roller DR. The rotating members PR are connected to a rotating member pushing mechanism 7, which is connected via a connecting piping 94 to a forcing pressure control section 70 for changing over the forcing pressure for forcing the paper web W onto the drag roller DR by the rotating members PR.

On the paper feeding sections SP1 and SP2 provided are a plurality of support mechanisms (not shown) for web rolls WR, each of which has a printing material braking mechanism 8 having an air-operated brake, for example. The printing material braking mechanism 8 is connected via a connecting piping 95 to a printing material braking control section 80 for changing over braking forces for the paper web W.

On the other hand, an uninterruptible power supply 1 connected to an external power supply (not shown) is provided. As shown in FIG. 2, the uninterruptible power supply 1 has a converter 11 on the power input side thereof, an inverter 13 on the power output side thereof, a battery power supply 12 and a power failure signal output section 14. The uninterruptible power supply 1 converts in the converter 11 the a-c power fed from the external power supply into d-c power, which is in turn stored in the battery power supply 12, and reconverts the converted d-c power into a-c power in the inverter 13 for output. The power failure signal output section 14 detects a voltage drop of power fed to the converter 11 due to a failure of the external power supply, and outputs a power failure signal. The power failure signal output by the power failure signal output section 14 is sent via a connecting cable 96 to the rotation control signal output section 2, the moving mechanism control section 60, and the pushing force control section 70.

To the power output side of the uninterruptible power supply 1 connected via a connecting cable 91 are the drag roller drive source control apparatus 33, the moving mechanism control section 60, and the pushing force control section 70. Furthermore, the printing couple drive source control apparatus 30, the infeed roller drive source control apparatus 31, the outfeed roller drive source control apparatus 32, the nipping roller drive source control apparatus 34, the folding cylinder drive source control apparatus 35 and the printing material braking control section 80 are connected to an external power supply (not shown) via a connecting cable 90.

A symbol AD shown in the upper middle of FIG. 1 refers to a gathering mechanism for cutting the paper web W at the across-the-width center thereof in the direction parallel to the longitudinal direction, and arranging the cut paper sheets in such a manner that positions of images on the sheets that form the basis of cutting in the folding section agree with each other in the longitudinal direction. Detailed description, however, is omitted here since this mechanism is not related to the present invention.

Next, operation with the aforementioned construction will be described in the following, and the construction of the apparatus for controlling rotary press in a power failure as shown in FIG. 1 will be described in more detail, referring to block diagrams in FIGS. 2 through 5.

The rotary press is operated as usual so long as no trouble occurs in the external power supply. That is, when the external power supply is turned on, power is fed via the connecting cable 90 to the uninterruptible power supply 1, the printing couple drive source control section 30, the infeed roller drive source control section 31, the outfeed roller drive source control section 32, the nipping roller drive source control section 34, the folding cylinder drive source control section 35 and the printing material braking control section 80. Upon application of power, the uninterruptible power supply 1 converts the a-c power to d-c power in the converter 11 thereof, and reconverts the converted d-c power to a-c power, which is in turn fed to the rotation control signal output section 2, the drag roller drive source control section 33, the moving mechanism control section 60 and the pushing force control section 70. In the uninterruptible power supply 1, the power converted from a-c to d-c is stored in the battery power supply 12.

Once this state is reached, a rotary press operation signal, such as start and then increase the speed, is input from the input operation section 21 of the rotation control signal output section 2 (refer to FIG. 3) to operate the rotary press. The rotation control signal output section 2 into which the operation signal was input gives an instruction to the control signal generating section 23 to output a control signal corresponding to the operation signal input by the processing section 22, such as a reference pulse signal indicating the rotation reference. Upon receipt of the signal output instruction given by the processing section 22, the control signal generating section 23 outputs a control signal in accordance with the instruction. This signal is output to the connecting cable 92 via an output-side interface 24.

Figure 5:
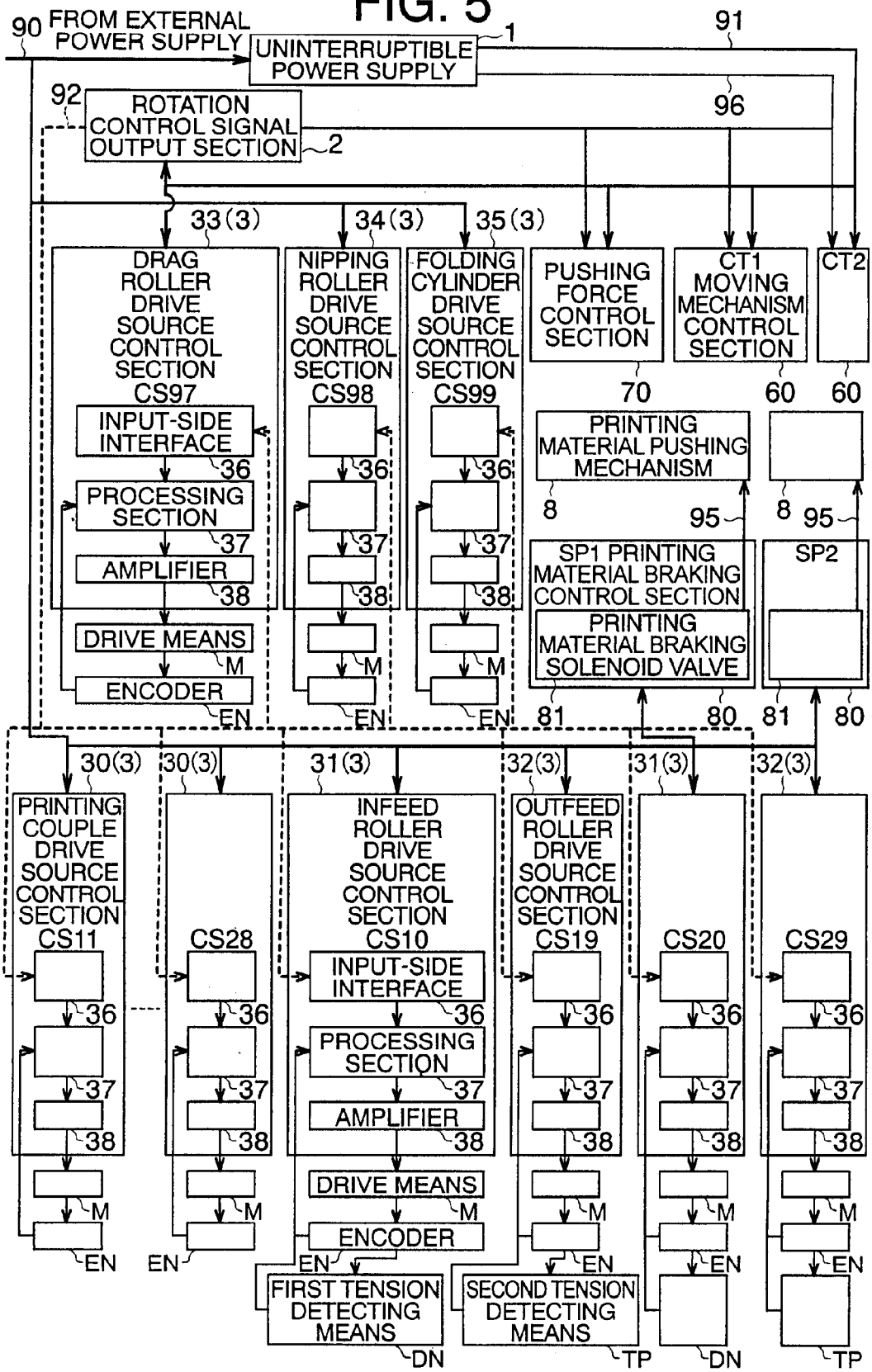
FIG. 5 is a block diagram showing the construction of the control apparatus in the event of a power failure and showing in more detail the construction of the drive source control section and the printing material braking control section.

The signal output to the connecting cable 92 by the rotation control signal output section 2 is input to each drive source control section 3 via the input-side interface 36, as shown in FIG. 5. The drive source control section 3 receiving the signal output by the rotation control signal output section 2 processes the signal in the processing section 37 to extract a reference phase and a reference speed, extracts the phase and speed at that point of time of the corresponding drive means M from a first pulse signal and a second pulse signal output by the encoder EN, compares the phase at that point of time of the drive means M with the extracted reference phase, compares the speed at that point of time of the drive means M with the reference speed, outputs a corrected signal that corrected the reference speed to eliminate the speed and phase differences, and feeds an appropriate drive power corresponding to the corrected signal to the drive means M via an amplifier 38. When correcting the reference speed, the infeed roller drive source control section 31 of the drive source control section 3 also receives and corrects the output signal of the first tension detecting means DN, whereas the outfeed roller drive source control section 32 also receives and corrects the output signal of the second tension detecting means TP when correcting the reference speed.

In this way, the driving and rotating sections of the rotary press are synchronously operated.

During this synchronous operation, the moving mechanism control section 60 (refer to FIG. 4) changes over a blanket cylinder changeover solenoid valve 61 at a predetermined appropriate timing after the start of the rotary press to operate the blanket cylinder changeover mechanism 6, bringing and maintaining the blanket surface of the blanket cylinder BC into contact with the paper web W that is being traveled under the synchronous operation. The pushing force control section 70 (refer to FIG. 4) feed a predetermined air pressure to the rotating member pushing mechanism 7 with an electro-pneumatic converter 71 along with the start of the rotary press to push the rotating member PR to the drag roller DR, forcing the paper web W that is guided in contact with the drag roller DR onto the drag roller DR via the rotating member PR. The printing material braking control section 80 changes over a printing material braking solenoid valve 81 in accordance with the diameter of the web roll WR of the paper web W at the start of printing to operate the printing material braking mechanism 8 so that braking is accomplished in accordance with the diameter of the web roll WR of the paper web W at the start of printing, while adjusting at all times air pressure fed to the printing material braking mechanism 8 in accordance with the paper-feeding tension detected by a publicly known paper-feeding tension detecting means (not shown). The diameter of the web roll WR of the paper web W at the start of printing may be detected with an appropriate publicly known detecting means (not shown).

If the external power supply fails when the rotary press is being normally operated under the aforementioned condition, the apparatus for controlling the rotary press in a power failure as shown in FIG. 1 starts control operation in the following manner.

That is, as is apparent by referring to FIG. 2, the uninterruptible power supply 1 outputs a power failure signal as the power failure signal output section 14 detects a drop of the voltage of power into the converter 11, and the battery power supply 12 outputs a d-c power, which is converted into an a-c power in the inverter 13. The power failure signal output by the uninterruptible power supply 1 is input to the rotation control signal output section 2, the moving mechanism control section 60, and the pushing force control section 70 via the connecting cable 96, while the a-c power, based on the d-c power from the battery power supply 12, output by the uninterruptible power supply 1 is input to the rotation control signal output section 2, the drag roller drive source control section 33, the moving mechanism control section 60 and the pushing force control section 70 via the connecting cable 91.

On the other hand, power feeding to the printing couple drive source control section 30, the infeed roller drive source control section 31, the outfeed roller drive source control section 32, the nipping roller drive source control section 34, the folding cylinder drive source control section 35 and the printing material braking control section 80 that are connected directly to the external power supply via the connecting cable 90 is interrupted.

Then, the rotation control signal output section 2, to which the power failure signal and the a-c power based on the d-c power of the battery power supply 12 output by the uninterruptible power supply 1 have been simultaneously input, outputs a signal indicating a rotation reference for causing the driving means M to rotate so that those driven components are decelerated and stopped in a predetermined time, 15 seconds, for example. The drag roller drive source control section 33, to which the a-c power based on the d-c power of the battery power supply 12 output by the uninterruptible power supply 1 is input, controls the rotation of the drag roller DR in accordance with the signal output by the uninterruptible power supply 1 for indicating the rotation reference for rotating to decelerate and stop the drive means M. In addition, the pushing force control section 70, to which the power failure signal and the a-c power based on the d-c power of the battery power supply 12 output by the uninterruptible power supply 1 have been input, maintains the air pressure that was predetermined in the electro-pneumatic converter 71, or changes the air pressure that was predetermined by the electro-pneumatic converter 71 to a higher value to supply to the rotating member pushing mechanism 7 so as to force the rotating member PR onto the drag roller DR, thereby keeping the state that the paper web W is kept forced onto the drag roller DR via the rotating member PR. Consequently, even after a trouble occurs in the external power supply, the drag roller DR keeps tensioning the paper web W while decelerating under controlled rotation, and eventually bringing the paper web W to a halt.

The moving mechanism control section 60, to which the power failure signal and the a-c power based on the d-c power of the battery power supply 12 output by the uninterruptible power supply 1 have been input, immediately changes over the blanket cylinder movement changeover solenoid valve 61, actuating the blanket cylinder changeover mechanism 6 to separate the blanket surface of the blanket cylinder BC away from the paper web W and maintain that state, as shown in FIG. 4.

On the other hand, the printing couple drive source control section 30, the infeed roller drive source control section 31, the outfeed roller drive source control section 32, the nipping roller drive source control section 34 and the folding cylinder drive source control section 35 stops the control operation as power supply to them has been interrupted. Consequently, both the plate cylinder PC and the blanket cylinder BC constituting a printing couple, the infeed roller IN, and the outfeed roller OT are changed over from the controlled rotation by the drive means M to the rotation by inertial force. However, since the blanket surface of the blanket cylinder BC is separated from the paper web W, as described above, there is no fear of the large and uneven tension produced by the rotation of the printing couple being exerted onto the paper web W.

The printing material braking control section 80, to which power supply has been interrupted, is changed over to a state where the printing material braking mechanism 8 gives full play to the braking function thereof independently of the diameter of the web roll WR of the paper web W or of the paper feeding tension as the printing material braking solenoid valve 81 is changed by a built-in spring.

As described above, when a trouble occurs in the external power supply of the rotary press, the paper web W separated from the blanket cylinder BC is tensioned by the controlled rotation of the drag roller DR under the state where the printing material braking mechanisms 8 of the paper feeding sections SP1 and SP2 give full play to the maximum braking function thereof, and brought to a halt within a predetermined time. Since no uneven and large tension is exerted until the rotary press is stopped, there is no fear of the breakage of the paper web W.

Needless to say, the power failure signal and the a-c power based on the d-c power of the battery power supply 12 output by the uninterruptible power supply 1 may be applied to the drag roller drive source control section 33, and to the infeed roller drive source control section 31, the outfeed roller drive source control section 32, the nipping roller drive source control section 34 and the folding cylinder drive source control section 35 to cause the drive means M corresponding to each of these to perform the same control as the control of the drive means M for the drag roller DR by the drag roller drive source control section 33. Furthermore, the drive means M for driving the printing couple drive source control section 3 and the printing couples may be adapted to perform similar operations.

As described above, the present invention makes it possible to apply to an electrically synchronous-controlled shaftless rotary press to eliminate, in case power feeding is interrupted in a main power failure, the breakage of a paper web due to an uneven tension exerted onto the paper web that travels in the rotary press. As a result, the broken paper web is prevented from being wound on the rotary component of the rotary press, allowing the rotary press to resume printing operation immediately after the power is restored, eliminating major troubles in high-speed, timely printing operations, such as newspaper printing. The present invention is also extremely effective in improving the operating efficiency of the rotary press.

What is claimed is:

1. A method for controlling, in a power failure, a rotary press having a printing section and a folding section separately driven by independent drive sources, with a printing material, while being braked by a paper feeding section, being pulled by at least the folding section and brought into contact with a blanket cylinder of the printing section to produce printing impressions on the printing material, the method comprising steps of:

changing over the braking of the printing material in the paper feeding section to a braking mode with a constant braking force upon interruption of power feeding due to a main power failure;

outputting a power failure signal upon detection of a voltage drop as the result of the power failure and changing over the power supply to a battery power supply;

separating the blanket cylinder that is at press from the printing material by applying the power failure signal and a power from the battery power supply; and decelerating and bringing to a halt a printing material pulling mechanism in the folding section by applying the power failure signal and the power from the battery power supply.

2. A method for controlling, in a power failure, a rotary press having a printing section and a folding section separately driven by independent drive sources, with a printing material, while being braked by a paper feeding section, being pulled by at least the folding section and brought into contact with a blanket cylinder of the printing section to produce printing impressions on the printing material; the method comprising steps of:

changing over the braking of the printing material in the paper feeding section to a braking mode with a constant braking force that is greater than the braking force before the power failure upon interruption of power feeding due to a main power failure;

outputting a power failure signal upon detection of a voltage drop as the result of the power failure and changing over the power supply to a battery power supply;

separating the blanket cylinder that is at press from the printing material by applying the power failure signal and a power from the battery power supply; and decelerating and bringing to a halt a printing material pulling mechanism in the folding section by applying the power failure signal and the power from the battery power supply.

3. An apparatus for controlling, in a power failure, a rotary press having independent drive sources in a printing section and a folding section, a printing material braking mechanism for braking the pulling of the printing material in the paper feeding section, a blanket cylinder moving mechanism for selectively moving the blanket cylinder in the direction making contact with, or separating from, the printing material in the printing section, and a printing material pulling mechanism for pulling the printing material by the rotation of the drag roller at least on the upstream side of the folding section, the apparatus comprising:

a printing material braking mechanism adapted so that braking force can be changed over to a braking mode with a constant braking force upon interruption of power feeding in a main power failure;

an uninterruptible power supply having a power failure signal output section whose power input side connected to an external power supply for outputting a power failure signal by detecting a voltage drop on the power input side thereof in the event of a power failure, and a battery power supply for outputting a power to the power output side thereof along with the voltage drop on the power input side in a power failure;

a drive source control section provided for each drive source for the printing section and the folding section for controlling the rotation of the drive sources;

a rotation control signal output section for outputting a signal for synchronously controlling the rotation of each drive source;

a moving mechanism controlling section for operating the blanket cylinder moving mechanism so as to selectively causing the blanket cylinder to make contact with, or separate from, the printing material, and at least a drag roller drive source control section of the printing material pulling mechanism on the most upstream side of the folding section, the rotation control signal output section, and the moving mechanism control section being connected to the power output side of the uninterruptible power supply, at least the rotation control signal output section and the moving mechanism control section being connected to the power failure signal output section of the uninterruptible power supply so that the blanket cylinder is separated from the printing material based on the signal output by the power failure signal output section, and the printing material pulling mechanism on the most upstream side of the folding section is controlled with the output signal output by the rotation control signal output section and brought to a halt.

4. An apparatus for controlling, in a power failure, a rotary press as set forth in claim 3 wherein the rotation control signal output section is provided so as to output a signal indicating the rotation reference for rotating each drive source.

5. An apparatus for controlling, in a power failure, a rotary press as set forth in claim 3 wherein the printing material pulling mechanism on the upstream side of the folding section has a rotating member that is rotatable while pushing the drag roller onto the printing material, and a pushing force controlling section for changing over pushing forces of the rotating member onto the drag roller; the pushing force control section being connected to the power output side of the uninterruptible power supply and to the power failure signal output section of the uninterruptible power supply; and the pushing force of the rotating member onto the drag roller being strengthen based on a signal output by the power failure signal output section.

6. An apparatus for controlling, in a power failure, a rotary press as set forth in claim 3 wherein a braking force in a power failure is adapted to be higher than the braking force before the power failure.

7. An apparatus for controlling, in a power failure, a rotary press as set forth in claim 6 wherein the rotation control signal output section is adapted to output a signal indicating the rotation reference for rotating each drive source.

8. An apparatus for controlling, in a power failure, a rotary press as set forth in claim 6 wherein the printing material pulling mechanism on the most upstream side of the folding section has a rotating member that is rotatable while pushing the printing material onto the drag roller, and a pushing force control section for changing over the pushing force of the rotating member onto the drag roller; the pushing force control section being connected to the power output side of the uninterruptible power supply and to the power failure signal output section of the uninterruptible power supply so that the pushing force of the rotating member onto the drag roller being strengthened based on the signal output by the power failure signal output section.

* * * * *